US007690078B2

(12) United States Patent
Zahuranec et al.

(10) Patent No.: US 7,690,078 B2
(45) Date of Patent: Apr. 6, 2010

(54) VACUUM CLEANER WITH REMOVABLE CLEANING ATTACHMENT

(75) Inventors: Terry L. Zahuranec, North Olmsted, OH (US); David Scott Smith, Avon Lake, OH (US); Daniel L. Steele, Concord, OH (US)

(73) Assignee: The Scott Fetzer Company, Westlake, OH (US)

( * ) Notice: Subject to any disclaimer, the term of this patent is extended or adjusted under 35 U.S.C. 154(b) by 1190 days.

(21) Appl. No.: 11/264,916

(22) Filed: Nov. 2, 2005

(65) Prior Publication Data

US 2007/0094838 A1 May 3, 2007

(51) Int. Cl.
*A47L 5/00* (2006.01)
*A47L 9/00* (2006.01)

(52) U.S. Cl. ..... 15/337; 15/383

(58) Field of Classification Search ..... 15/328, 15/329, 331, 334, 338, 375, 376, 320, 321, 15/322, 327.2, 337; *A47L 9/00, 5/00*
See application file for complete search history.

(56) References Cited

U.S. PATENT DOCUMENTS 1,347,166 A * 7/1920 Kirby ..... 15/337
3,009,188 A 11/1961 Martin
3,273,194 A * 9/1966 Jepson et al. ..... 15/323
3,924,291 A 12/1975 Tschudy
3,968,938 A 7/1976 Ruhl et al.
4,225,999 A 10/1980 Martinec et al.
4,451,951 A 6/1984 Satoh
4,567,623 A 2/1986 Walton
4,663,799 A 5/1987 Kiyooka
4,683,608 A 8/1987 Berfield et al.
5,477,585 A 12/1995 Hentzschel et al.
6,058,559 A 5/2000 Yoshimi et al.
6,079,077 A * 6/2000 Kajihara et al. ..... 15/332
2002/0166196 A1* 11/2002 Boles et al. ..... 15/331
2003/0024068 A1* 2/2003 Tucker ..... 15/331
2004/0237246 A1* 12/2004 Nam et al. ..... 15/334
2006/0185115 A1* 8/2006 Yoo ..... 15/331
2006/0230572 A1* 10/2006 Lee et al. ..... 15/334

FOREIGN PATENT DOCUMENTS

KR 1020030033476 * 5/2003

* cited by examiner

*Primary Examiner*—Joseph J Hail, III
*Assistant Examiner*—Jamal Daniel
(74) *Attorney, Agent, or Firm*—Jones Day

(57) ABSTRACT

A vacuum cleaner includes a base having first and second inlet ports and a fan configured to draw air through the inlet ports into the base. A vacuuming head is removably attachable to the base to channel air from a surface into the first inlet port to clean the surface while covering and blocking the second inlet port. An attachment, different than the head, is removably attachable to the base to channel air into the second inlet port.

11 Claims, 13 Drawing Sheets

VACUUM CLEANER WITH REMOVABLE CLEANING ATTACHMENT

TECHNICAL FIELD

This application relates to vacuum cleaners.

BACKGROUND

A vacuum cleaner includes a base and a vacuuming head. The vacuuming head can be removably attached to the base for vacuuming a carpet.

SUMMARY

A vacuum cleaner includes a base having first and second inlet ports and a fan configured to draw air through the inlet ports into the base. A vacuuming head is removably attachable to the base to channel air from a surface into the first inlet port to clean the surface while covering and blocking the second inlet port. An attachment, different than the head, is removably attachable to the base to channel air into the second inlet port.

The attachment can be configured to cover and block the first inlet port when the attachment is removably attached to the base. The fan can have an inlet through which the fan draws air from the inlet ports, and the attachment can be configured to be inserted through second inlet port and, within the base, isolate the first inlet port from the fan inlet. Both inlet ports are preferably at a front end of the base.

Another vacuum cleaner has a base with a front end, first and second inlet ports in the front end and an impeller behind the ports. The base defines a first flow path extending continuously rearward from the first inlet port to the impeller and a second flow path extending continuously rearward from the second inlet port to the impeller. A vacuuming head is removably attachable to the base to conduct air from a surface into the first inlet port to clean the surface. An attachment, different than the head, is removably attachable to the base to conduct air into the second inlet port.

DESCRIPTION

Overview

Figure 1:
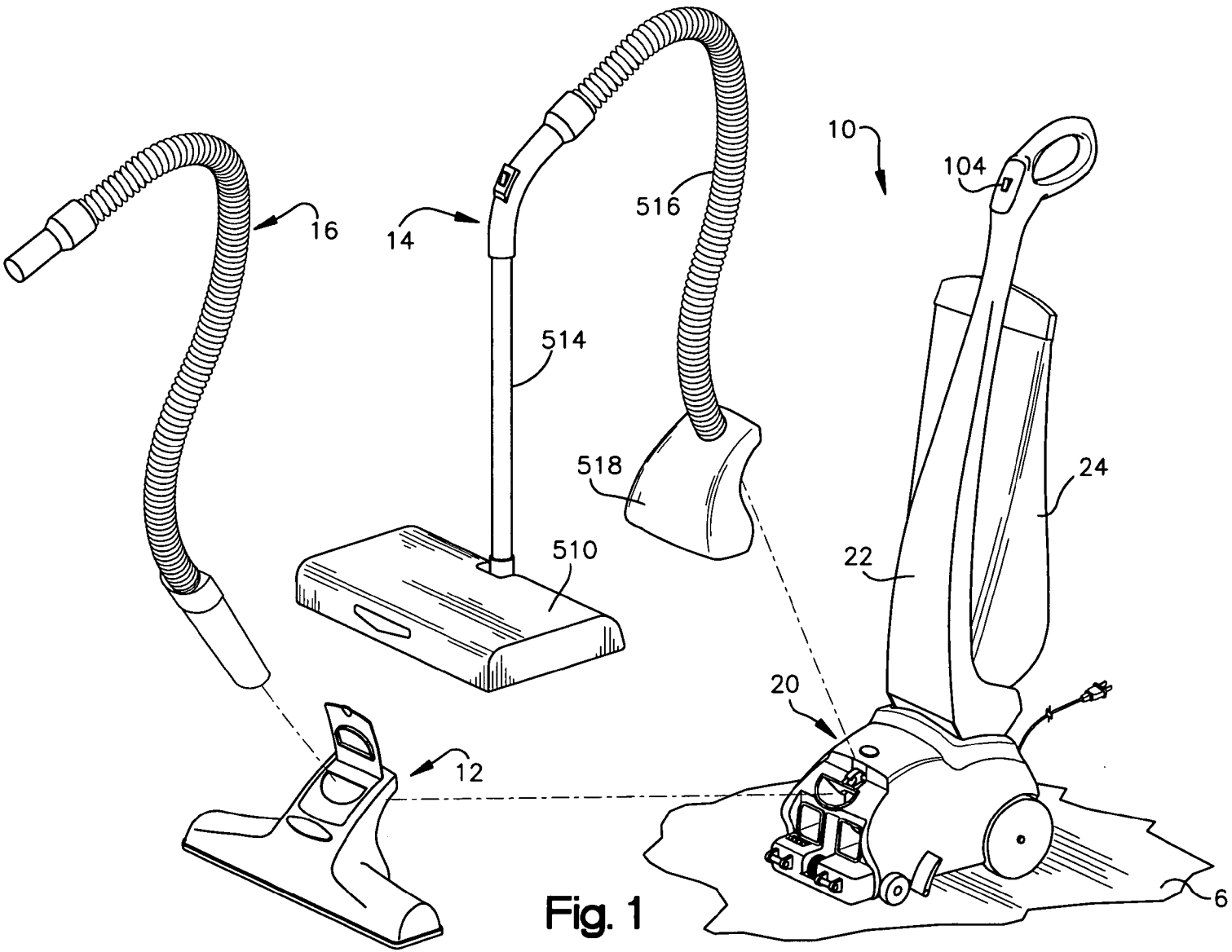
FIG. 1 is a perspective view of a vacuum cleaner base with a handle and a filter bag, and various cleaning attachments that can be removably attached to the base, including a vacuuming head, a power head assembly and an accessory hose.

The apparatus shown in FIG. 1 has parts that are examples of the elements recited in the claims. The apparatus thus includes examples of how a person of ordinary skill in the art can make and use the claimed invention. It is described here to meet the requirements of enablement and best mode without imposing limitations that are not recited in the claims.

The apparatus shown in FIG. 1 is used for cleaning a carpeted floor 6. The apparatus includes a base unit 10 and three cleaning attachments for cleaning household surfaces—a vacuuming head 12, a power head assembly 14 and an accessory hose 16. The vacuuming head 12 and the power head assembly 14 can be removably attached to the base unit 10 for vacuuming the floor 6. The hose 16 can be removably attached to the base unit 10 for vacuuming above-the-floor household surfaces.

Base

The base unit 10 comprises a base 20, a handle 22 extending upward from the base 20, and a filter bag 24 supported by the handle 22.

Figure 2:
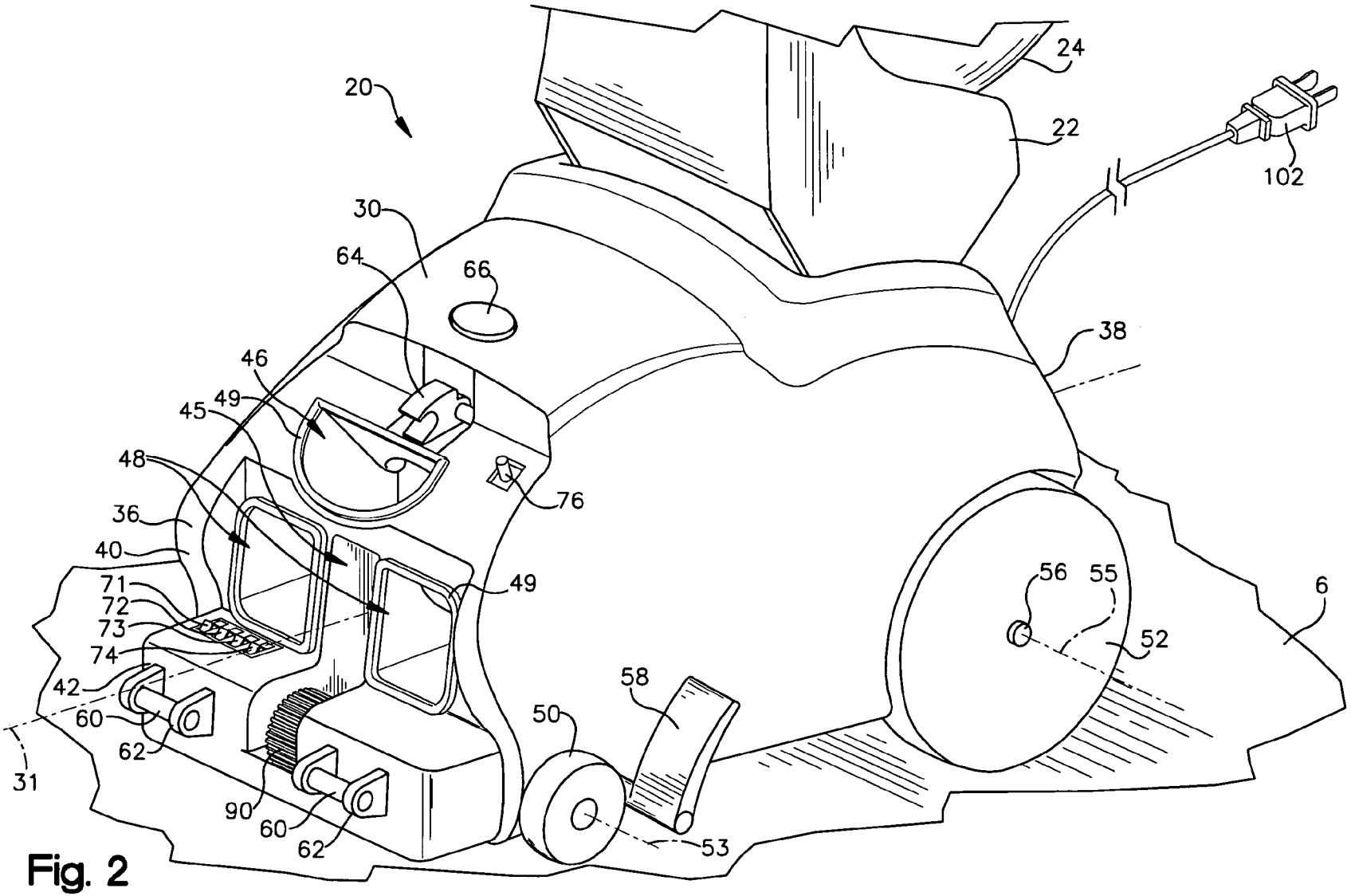
FIG. 2 is a perspective view of the base, showing its external parts.

As shown in FIG. 2, the base 20 has a housing 30 located on an axis 31. The housing 30 has axially front and rear ends 36 and 38. At the front end 36, the housing 30 has a front face 40 and a platform 42 projecting forward from the front face 40. A pocket 45 is transversely centered in the front face 40 and the platform 42. The front face 40 defines an upper inlet port 46 above the pocket 45 and two lower inlet ports 48 on either side of the pocket 45. Each inlet port 46 and 48 is surrounded by a rubber gasket 49.

Two front wheels 50 and two rear wheels 52 are respectively rotatable about parallel axes 53 and 55 for wheeling the base 20 over the floor 6. The rear wheels 52 are fixed to a common rear axle 56 that is rotatably connected to the housing 30. The front wheels 50 are rotatably connected to the housing 30 by a height-adjust mechanism 58 that enables a user to raise and lower the front end 36 relative to the floor 6.

Two transversely extending perch pins 60 are attached to the platform 42 by two pairs of support arms 62. A bear claw latch 64, with a release button 66, is attached to the top of the housing 30. Four electrical contacts 71, 72, 73 and 74—respectively designated ground, 5VDC-out, 24VDC-out and resistance-sense—are fixed to the platform 42. An attachment sensor 76 on the housing 30, in this example a pushbutton switch, senses whether the upper inlet port 46 is covered by a cleaning attachment.

Figure 3:
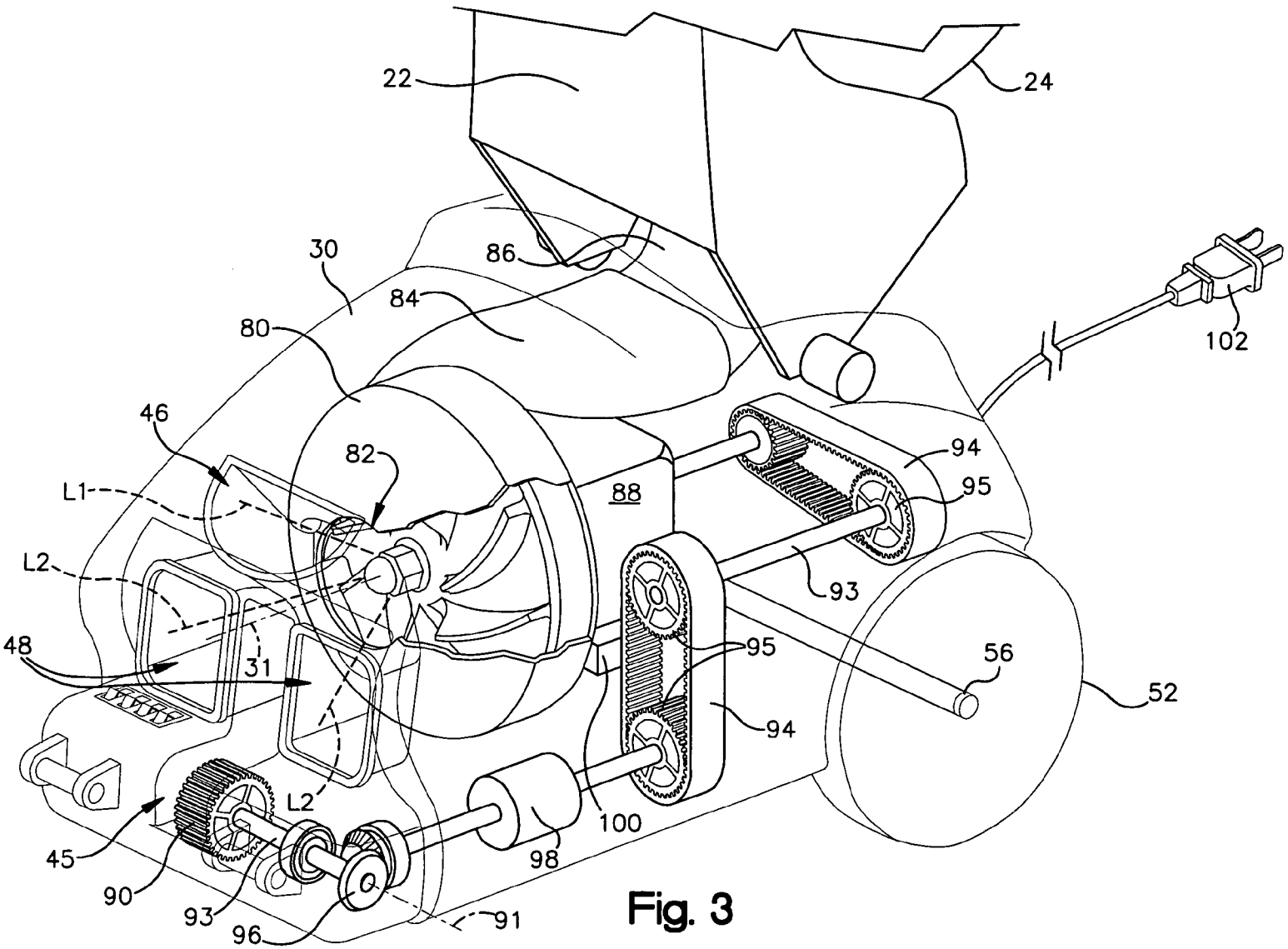
FIG. 3 is a perspective view of the base, showing its internal parts.

As shown in FIG. 3, a centrifugal fan 80 in the housing 30 has an inlet 82 connected to the inlet ports 46 and 48 and an outlet 84 connected by a fill tube 86 to the filter bag 24. The fan 80 further has an impeller 87 rotatable about the axis 31 and driven by a motor 88.

A toothed drive pulley 90 is located in the pocket 45 and is rotatable about a transversely extending rotational axis 91. The drive pulley 90 is driven by the motor 88 through a drive train that includes shafts 93, belts 94, pulleys 95, a bevel gear 96 and an electrically actuated clutch 98.

A controller circuit 100 is electrically connected to the electrical components 71-74, 76, 88, 98 of the base 20, shown in FIGS. 2-3, to monitor and control operation of the base 20. The circuit 100 receives wall current through a power cord 102. It generates a 5VDC supply and a 24VDC supply that are output respectively through the 5VDC-out contact 72 and the 24VDC-out contact 73. It senses electrical resistance applied across the sense contact 74 and ground contact 71 by whichever head 12 or 14 is installed on the base 20. Since each cleaning head applies a unique resistance, the controller 100 can determine which head, if any, is attached.

The controller 100 monitors a toggle-type power switch 104 (FIG. 1) in the handle 22 and turns the motor 88 alternately on and off each time the switch 104 is pressed. The circuit 100 refrains from powering the motor 88 when no cleaning attachment is installed or the upper inlet port 46 is uncovered, as determined by the attachment sensor 76. If a cleaning attachment is detached while the motor 88 is running, the controller 100 will immediately cease powering the motor 88 until the attachment is reattached as indicated by the sensor 76 and the power switch 104 is pressed.

If a cleaning attachment different from the vacuuming nozzle 12 is installed, as determined through the resistance-sense contact 74, the controller 100 will power the motor 88 when the power switch 104 is pressed but keep the clutch 98 disengaged, which disengages the drive pulley 90 from the motor 88. This enables the motor 88 to drive the fan 80 without driving the drive pulley 90.

Vacuuming Head

Figure 4:
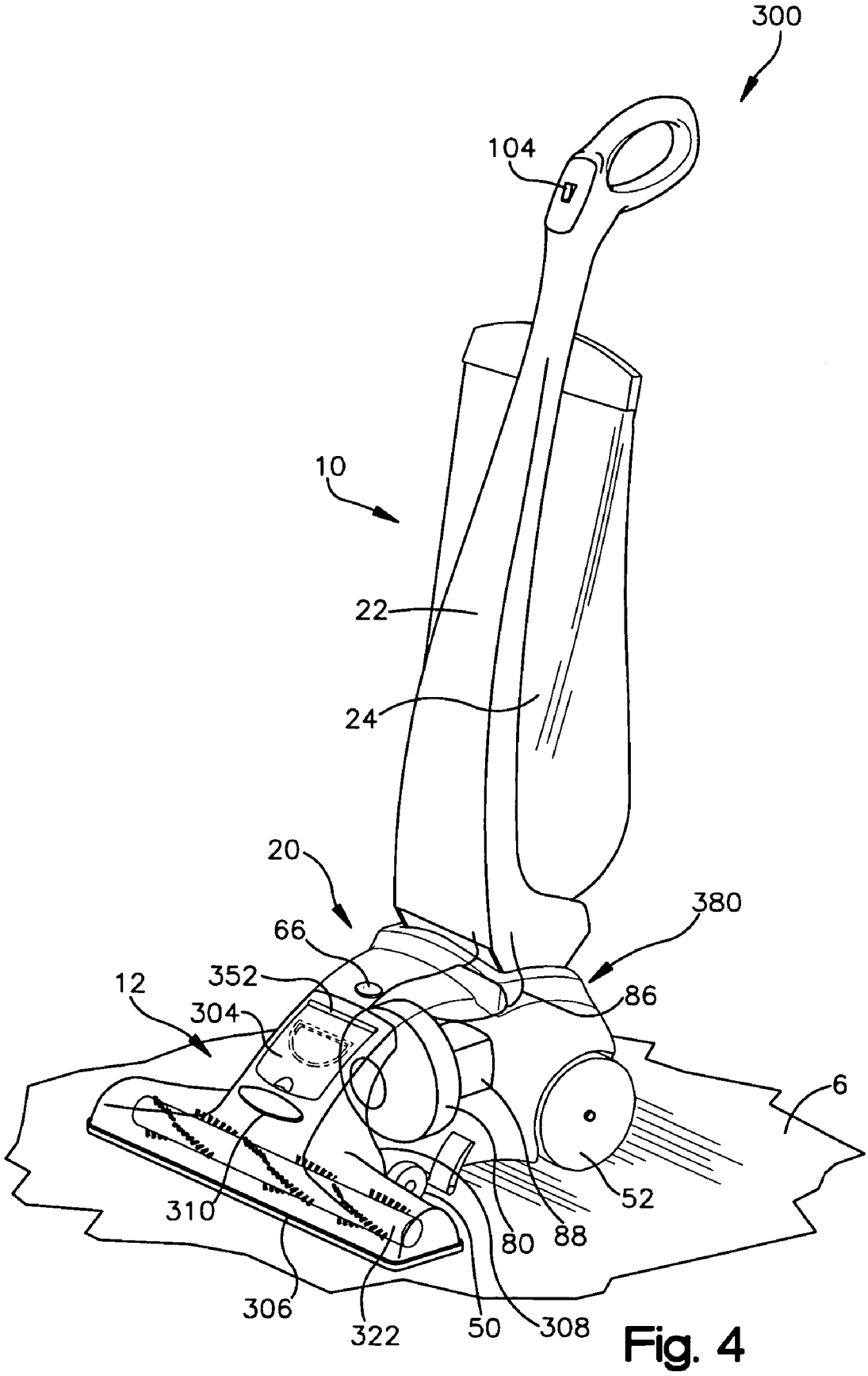
FIG. 4 is a front perspective view of the vacuuming head shown attached to the base.

FIG. 4 shows a vacuum cleaner 300 comprising the vacuuming head 12 attached to the base unit 10. The vacuuming head 12 includes a housing 304 with front and rear ends 306 and 308. A headlamp 310 at the front end 306 is configured to illuminate the floor 6 in front of the head 12.

Figure 5:
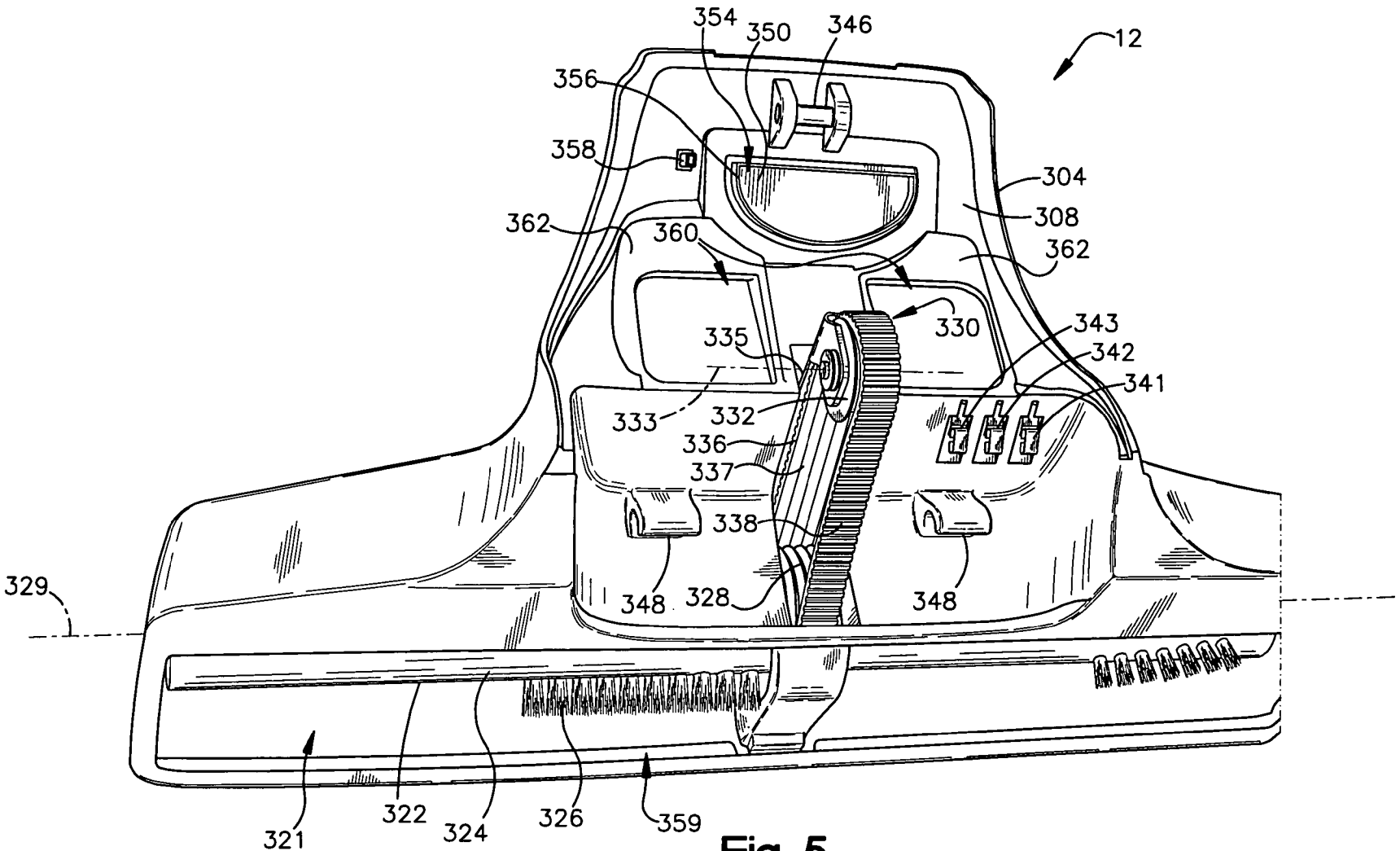
FIG. 5 is a rear perspective view of the vacuuming head.

As shown in FIG. 5, the housing 304 defines a nozzle cavity 321 and rotatably supports a brushroll 322 in the cavity 321. The brushroll 322 includes a dowel 324 and bristles 326 projecting from the dowel 324. The dowel 324 has a poly-V surface section 328 and is rotatable about an axis 329.

A drive coupling assembly 330 is configured to couple the brushroll 322 to the drive pulley 90 (FIG. 2) of the base 20 for the drive pulley 90 to drive the brushroll 322. The coupling assembly 330 includes an idler pulley 332 located outside the nozzle cavity 321 and rotatable about an axis 333 parallel to the brushroll axis 329. The idler pulley 332 is mounted to the housing 304 by an elastically flexible arm 335 cantilevered from the housing 304. A belt 336 extends permanently about the brushroll 322 and the idler pulley 332 and is thus partially inside and partially outside the nozzle cavity 321. The belt 336 has a poly-V inner surface 337 and a gear-toothed outer surface 338.

Three electrical contacts 341, 342, 343—ground, power-in, and resistance-out—are attached to the rear 308 of the housing 304. They are configured to respectively contact the ground, 5VDC-out and resistance sense contacts 71, 72 and 74 (FIG. 2) of the base 20. The ground and power-in contacts 341 and 342 are electrically connected to the headlamp 310 (FIG. 4) to power the headlamp 310 with 5VDC supplied by the base 20. The ground and resistance-out contacts 341 and 343 are connected across a resistor (not shown) in the head 12 with a resistance value that is unique to the vacuuming head 12.

A latch pin 346 and two perch hooks 348 are adjoined to the rear 308 of the housing 304 for attaching the head 12 to the base 20. A door 350 is pivotably connected to the housing 304 by a hinge 352 (FIG. 4) to cover an upper opening 354 in the housing 304. A sealing surface 356 of the door 350 is configured to sealingly engage the upper gasket 49 of the base 20 (FIG. 2). A prong 358 projecting from the door 350 is configured to press the sensor switch 76 when the head 12 is attached to the base 20 and the door 350 is closed. Air enters the nozzle cavity 321 through an inlet opening 359 and exits the nozzle cavity 321 through two outlet openings 360. The outlet openings 360 are surrounded by sealing surfaces 362 configured to sealingly engage the two lower gaskets 49 of the base 20.

Figure 6:
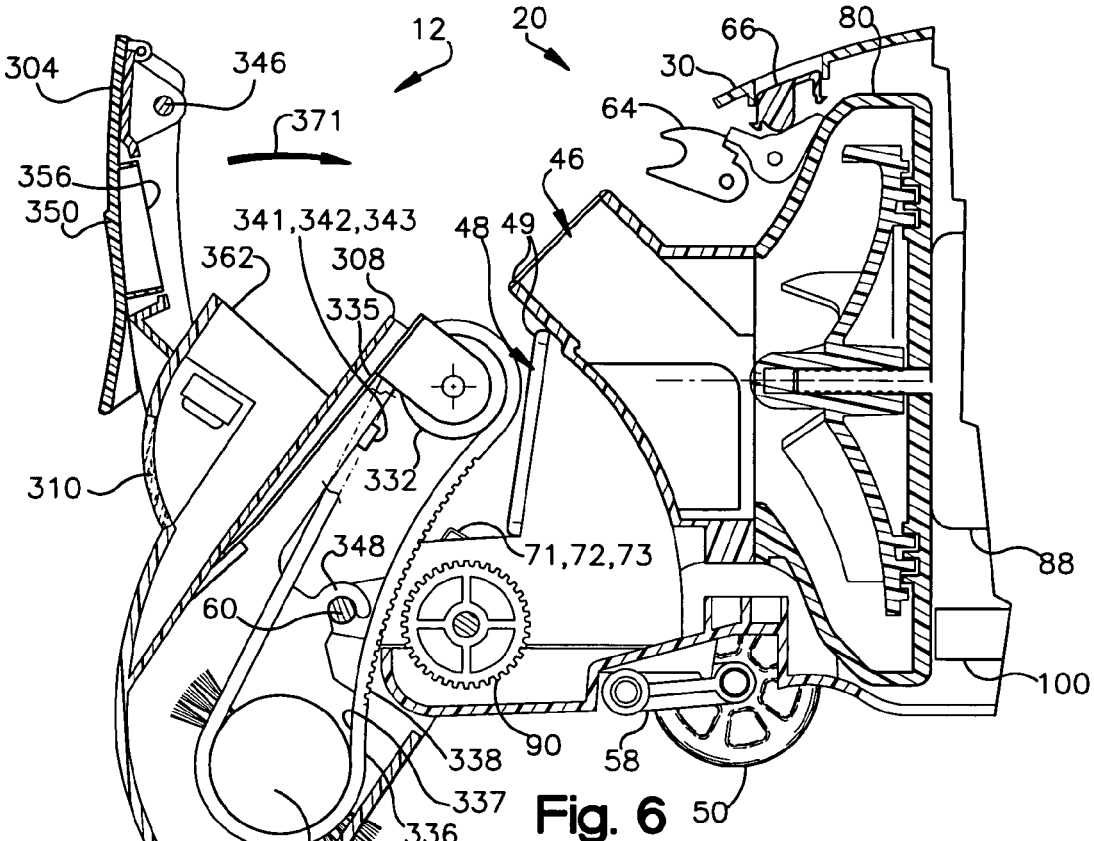
FIG. 6 is a side sectional view illustrating a procedure for attaching the vacuuming head to the base.
Figure 7:
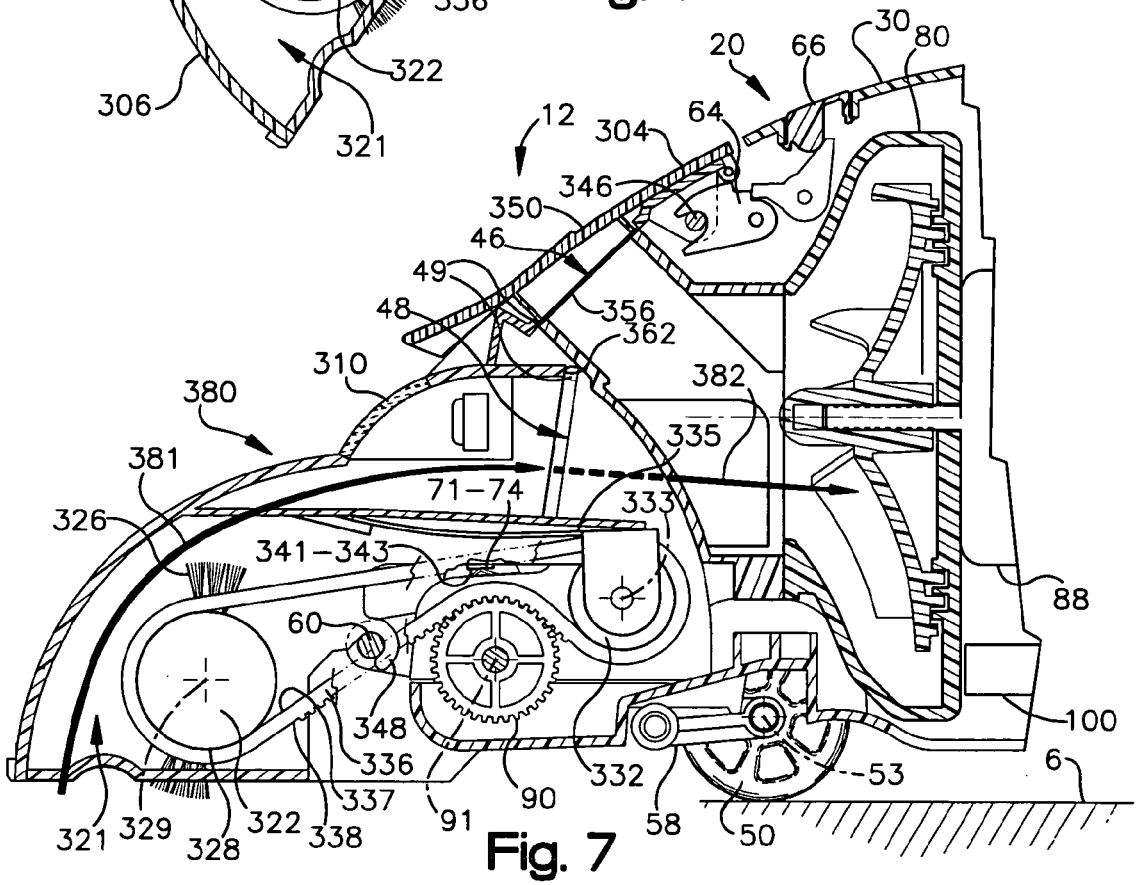
FIG. 7 is a side sectional view of the vacuuming head attached to the base.

FIG. 6 illustrates a procedure for attaching the head 12 to the base 20. First, the perch hooks 348 are mounted onto the perch pins 60 of the base 20. The arms 62 (FIG. 2) of the base 20 abut two opposite sides of the perch hooks 348 to keep the head 12 transversely centered on the base 20. Then, the head 12 is pivoted (arrow 371) rearward about the perch pins 60 until the latch pin 346 is captured by the latch 64 of the base 20 as shown in FIG. 7. The head 12 is thus removably attached to the base 20 in an installed position. The height-adjustment mechanism 58 can be adjusted to bring the brushroll bristles 326 into contact with the floor 6.

In the installation procedure shown in FIG. 6, the pivotal movement (arrow 371) of the head 12 toward and into the installed position moves the belt 336 toward and into engagement with the drive pulley 90, and also moves the contacts 341, 342 and 343 of the head 12 toward and into electrical contact with the contacts 71, 72 and 73 of the base 20, and further moves the sealing surfaces 356 and 362 of the head 12 into sealing contact with the three gaskets 49 of the base 20. The perch pins 60 facilitate the installation procedure by supporting the weight of the head 12 and by keeping components of the head 12 properly aligned with mating components of the base 20 while the head 12 is pivoted.

With the head 12 in its installed position as shown in FIG. 7, the following features are apparent: The head 12 is configured to channel air from the floor 6 into the lower inlet ports 48 while its door 350 covers and blocks the upper inlet port 46. The respective rotational axes 53, 55, 91, 329 and 333 of the front and rear wheels 50 and 52, the drive pulley 90, the brushroll 322 and the idler pulley 332 are all horizontal and parallel to each other and to the perch pins 60. They are all also perpendicular to movement of the base 20 as it is pushed forward and pulled rearward over the floor 6. The belt's poly-V inner surface 337 engages the idler pulley 332 and the poly-V surface 328 of the brushroll 322. The brushroll axis 329 and the idler pulley axis 333 are at opposite sides of the drive pulley axis 91, respectively in front of and behind the drive pulley axis 91. This enables the idler pulley 332 and the brushroll 322 to together pull the belt's toothed outer surface 338 down against, and partially about, the drive pulley 90.

The elastic pulley mounting arm 335 applies to the idler pulley 332 an elastic force pulling the belt 336 down against the drive pulley 90. The elastic nature of the pull force enables the position of the idler pulley 332 to adjust to variation in length of the belt 336 to maintain tension of the belt 336 against the drive pulley 90.

To detach the head 12 from the base 20, the latch release button 66 is pressed to release the latch pin 346. Then, the head 12 is pivoted away from the base 20 and lifted from the perch pins 60.

Figure 8:
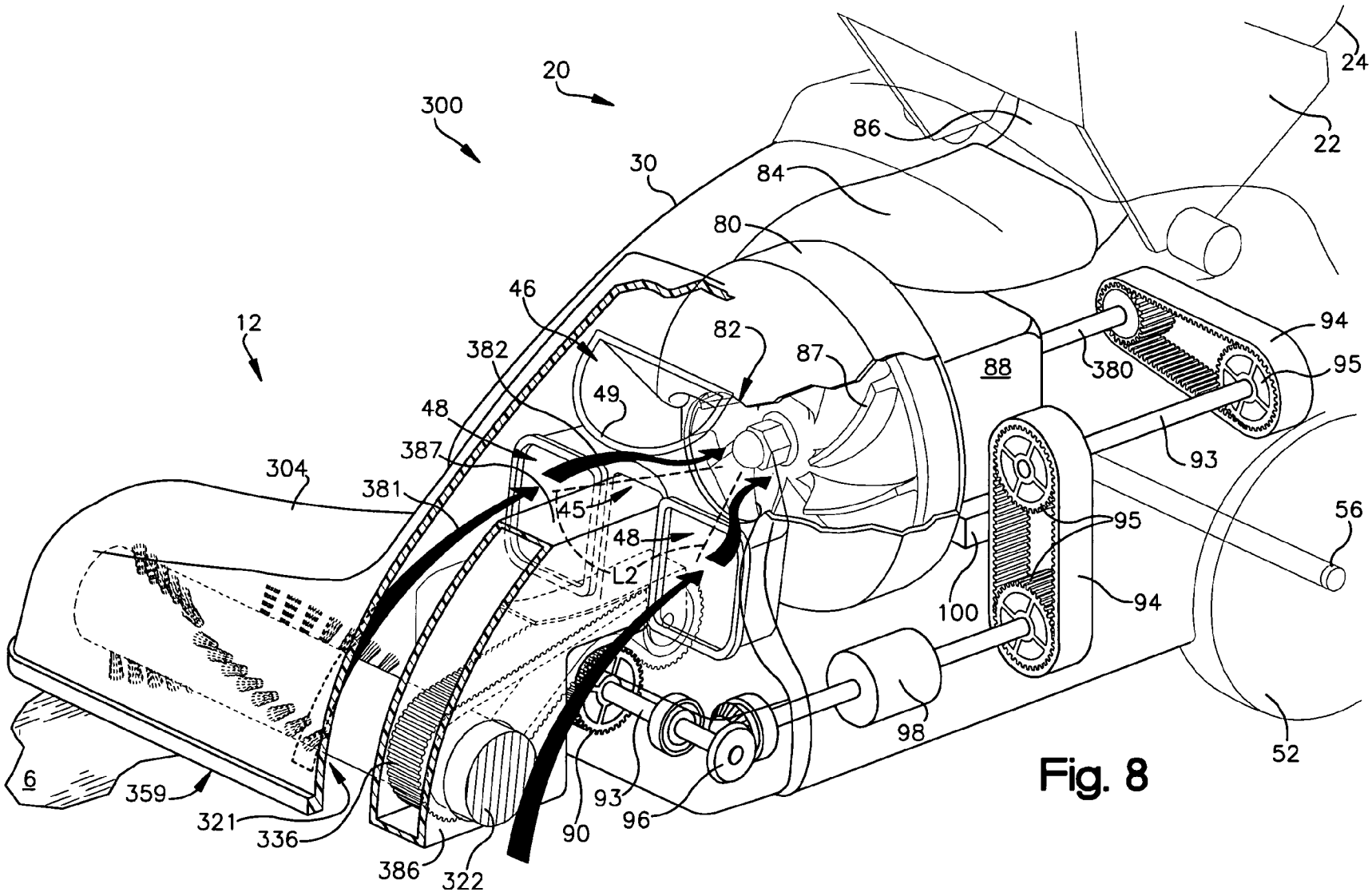
FIG. 8 is a perspective view illustrating operation of the vacuuming head and the base.

As shown in FIG. 8, the base 20, handle 22, bag 24 and vacuuming head 12 together comprise an upright vacuum cleaner 300. When the power switch 104 (FIG. 1) is pressed, the controller 100 powers the motor 88. The motor shaft 380 directly drives the impeller 87. It indirectly drives the brushroll 322 through a sequence of moving parts comprising the drive pulley 90, the drive belt 336, the shafts 93, the other belts 94 and pulleys 95, the bevel gear 96, and rotating parts of the clutch 98.

As the user moves the cleaner 300 over the floor 6, the brushroll 322 rotates against the floor 6 to dislodge dirt. The fan 80 generates an air flow that carries the dirt from the floor 6, through the nozzle cavity 321, the lower inlet ports 48 and the fan 80, into the filter bag 24. This route includes a split first flow path 381 extending from the head's inlet 359 to the base's lower inlet ports 48. The route further includes a split second flow path 382 extending continuously rearward from the lower inlet ports 48 to the impeller 87. The continuously-rearward character of the second flow path 382 is beneficial to flow efficiency. The efficiency is further benefited by the split second path 382 fully including two imaginary straight lines L2 extending, unobstructed, respectively from the two lower inlet ports 48 to the impeller 87.

As shown in FIG. 8, the sequence of moving parts conveying rotation of the motor shaft 380 to the brushroll 322 is spaced from, and does not extend through, the inlet ports 46 and 48 and the flow paths 381 and 382. The drive belt 336 is isolated from the first flow path 381 by a casing 386 that is part of the head housing 304.

Accessory Hose

Figure 9:
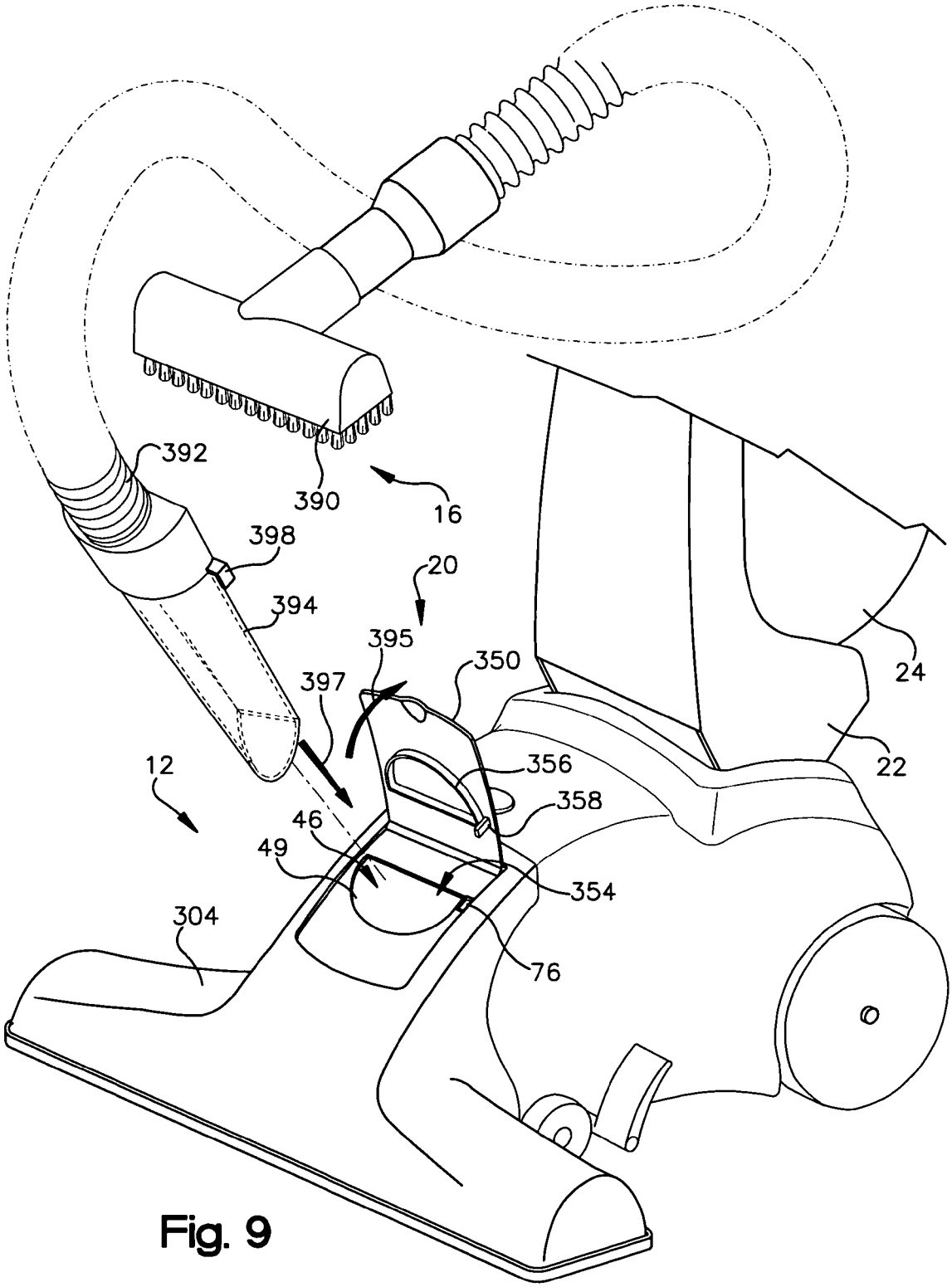
FIG. 9 is a perspective view illustrating a procedure for attaching the hose to the base.
Figure 10:
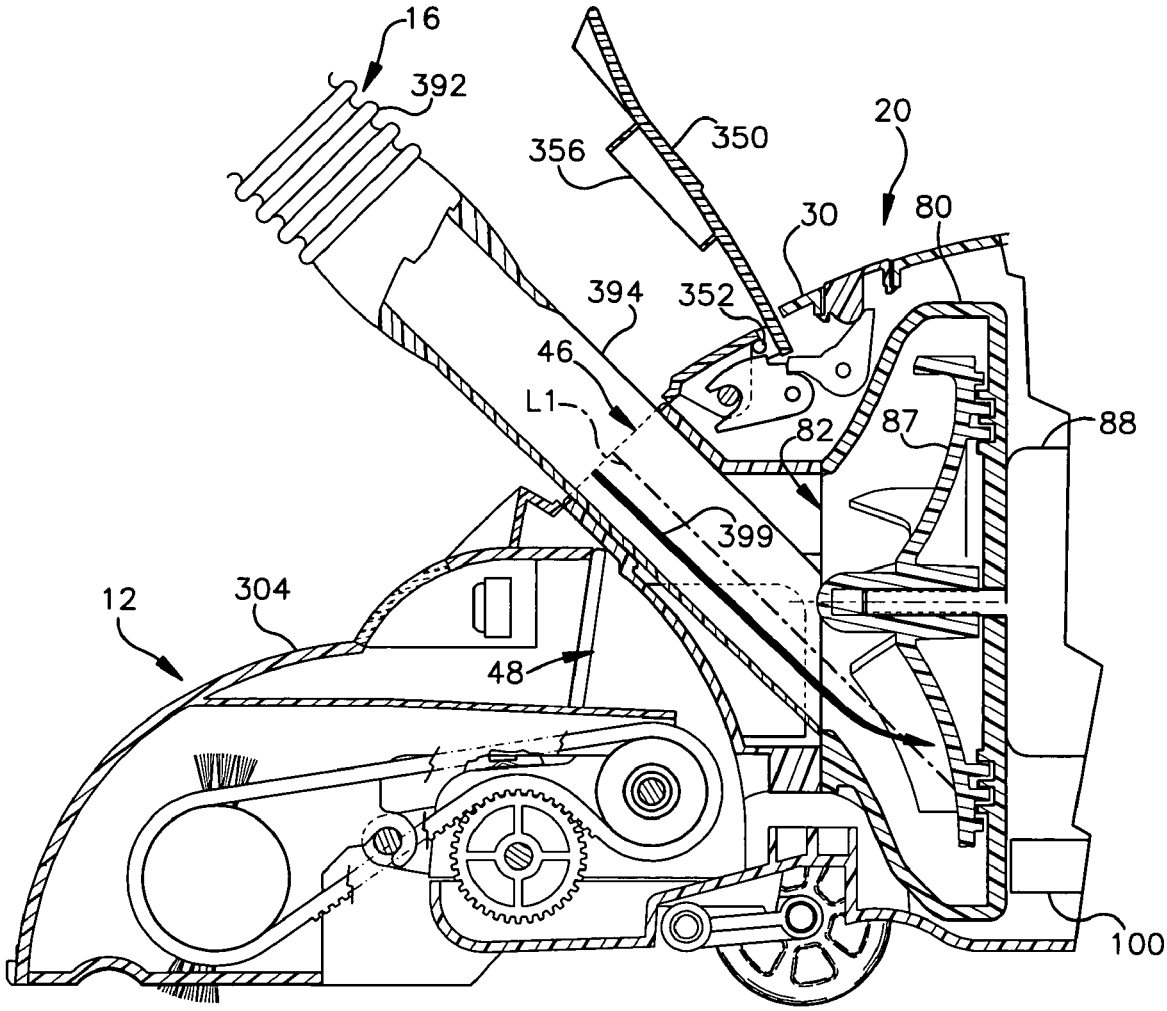
FIG. 10 is a side sectional view of both the hose and the vacuuming head attached to the base.

As shown in FIG. 9, the hose 16 is configured to connect a hose accessory, such as a brush attachment 390, to the base 20. The hose 16 includes a flexible tube 392 extending from a rigid scoop-shaped connector 394. A prong 398 projecting from the connector 394 is configured to engage the attachment sensor 76. The hose 16 can be installed on the base 20 by manually opening the door 350 (arrow 395) away from the upper inlet port 46, and inserting the hose connector 394 into the upper inlet port 46 (arrow 397) until the hose 16 is in an installed position shown in FIG. 10.

Within the base 20, the connector 394 sealingly engages the fan 80 and the base housing 30 to isolate the fan inlet 82 from the lower inlet ports 48, to block air from flowing from the lower inlet ports 48 to the fan inlet 82.

When the power switch 104 (FIG. 1) is pressed, the controller 100 powers the motor 88 to drive the fan 80. The fan 80 generates a flow of air that carries dirt from the surface being cleaned, through the hose 16, the upper inlet port 46 and the fan 80 into the bag 24 (FIG. 9). Preferably, this route includes a flow path 399 that extends continuously rearward from the upper inlet port 46 through the fan inlet 82 to the impeller 87. This path 399 fully includes an imaginary straight line L1 extending, unobstructed, from the upper inlet port 46 through the fan inlet 82 to the impeller 87.

Figure 11:
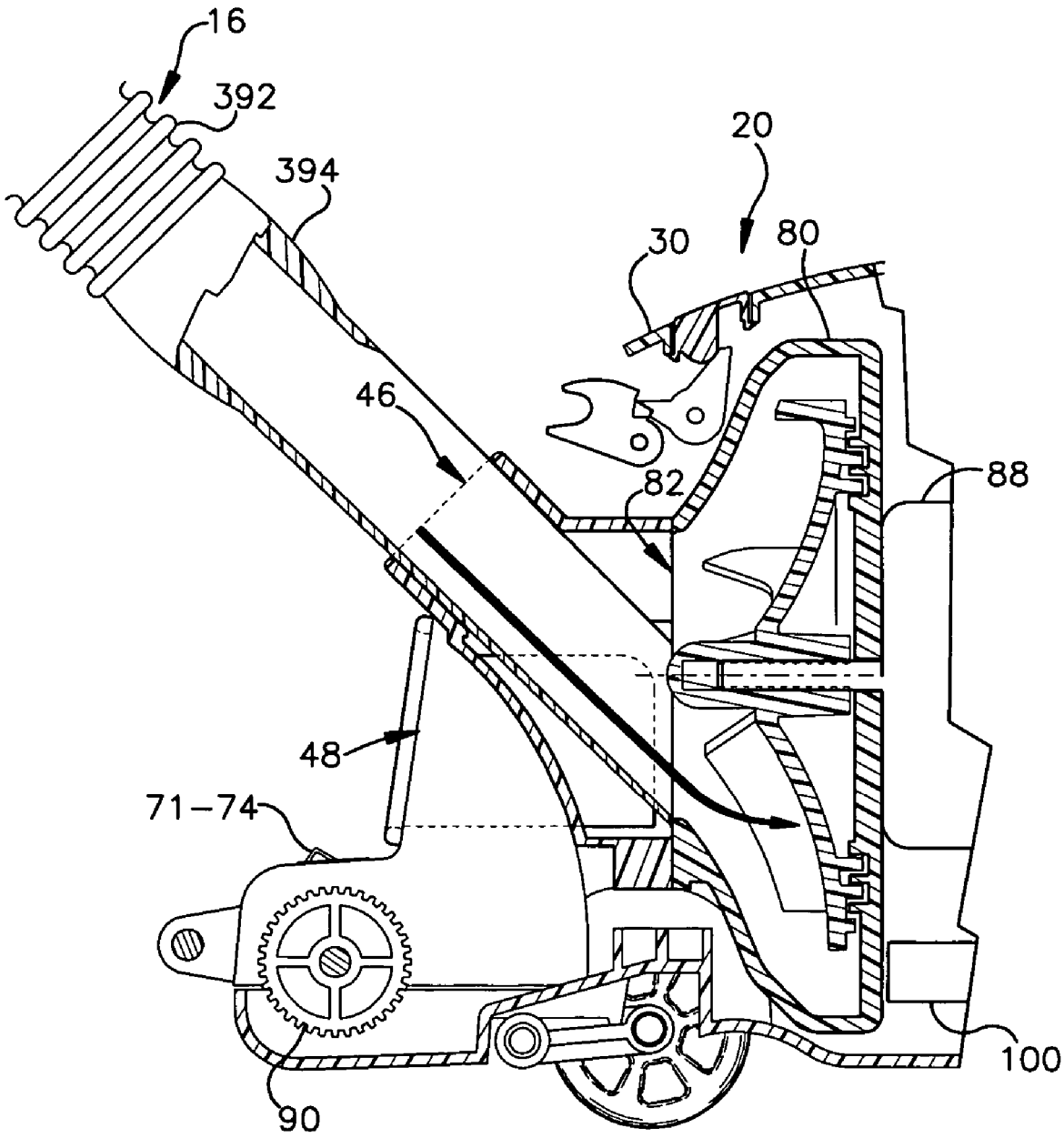
FIG. 11 is a side sectional view of the hose attached to the base without the vacuuming head.

As shown in FIG. 11, the hose 16 can be installed on the base 20 without the vacuuming head 12 and function as described above. By the lack of an applied resistance across the ground and resistance-sense contacts 71 and 74, the controller 100 determines that a head is not installed and disengages the clutch 98 (FIG. 3), and thus disengages the drive pulley 90 from the motor 88.

The hose 16 in this example is a cleaning attachment in that it is for cleaning household surfaces. In another example, the attachment is a vacuum powered tool that is not for cleaning, such as a vacuum powered sander. The sander can include an air motor that rotates a sanding disk and is connected to a tube that is removably insertable into the upper inlet port. Like the hose 16, the vacuum powered tool can be installed on the base 20 whether the vacuuming head 12 is installed or is absent.

Power Head Assembly

Figure 12:
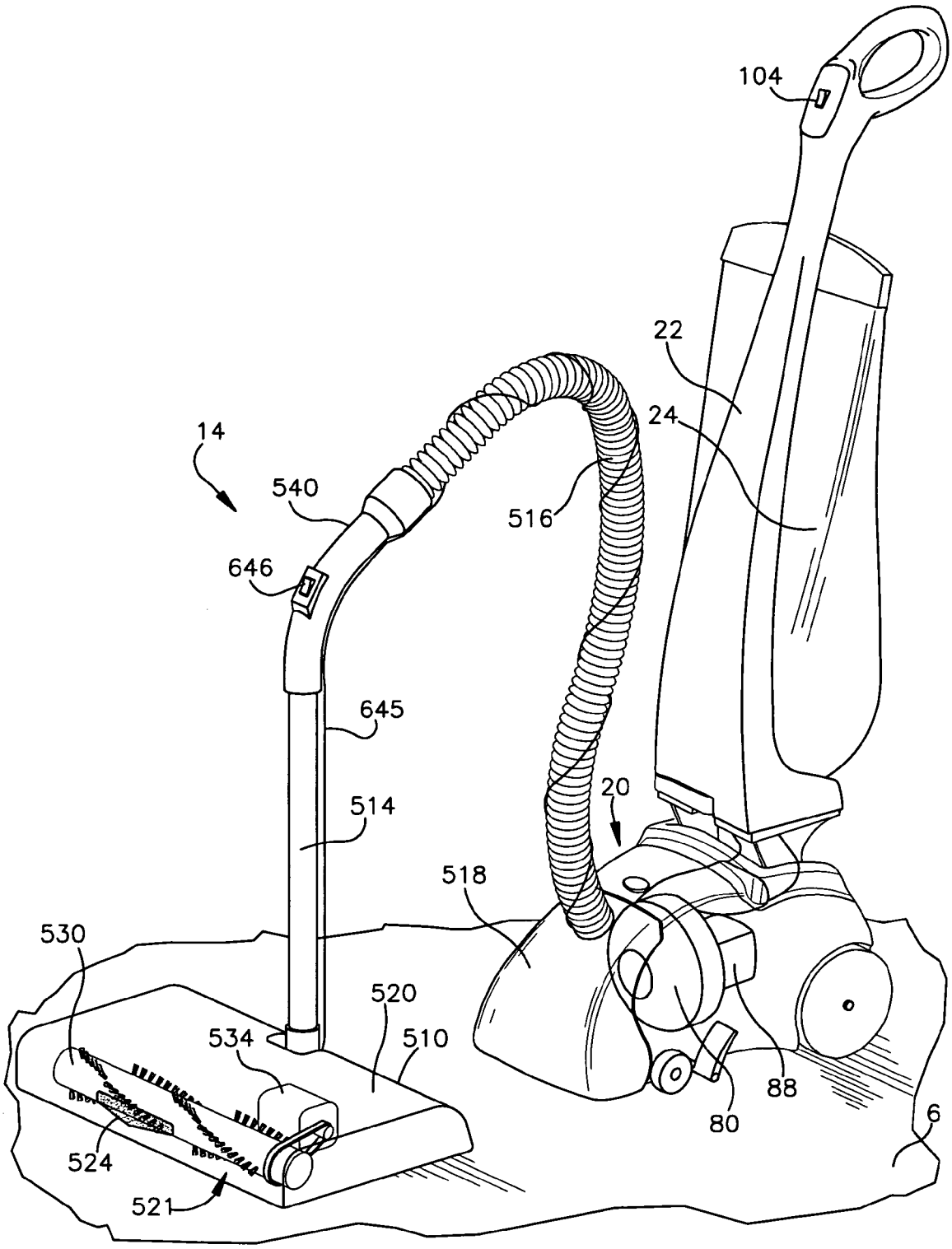
FIG. 12 is a perspective view of the power head assembly attached to the base.

FIG. 12 shows the power head assembly 14 attached to the base 20. The power head assembly 14 includes a power head 510, connected by a rigid tube 514 and a flexible tube 516 to an attachment plate connector 518.

The power head 510 includes a housing 520 defining a nozzle cavity 521. A headlamp 524 is secured to a front end of the housing 520. A brushroll 530 in the nozzle cavity 520 is driven by a motor 534 in the housing 520. The rigid tube 514 is pivotably connected to the power head 510 and has a handgrip 540, so that the tube 514 can be used as a handle for pushing the power head 510 over the floor 6.

Figure 13:
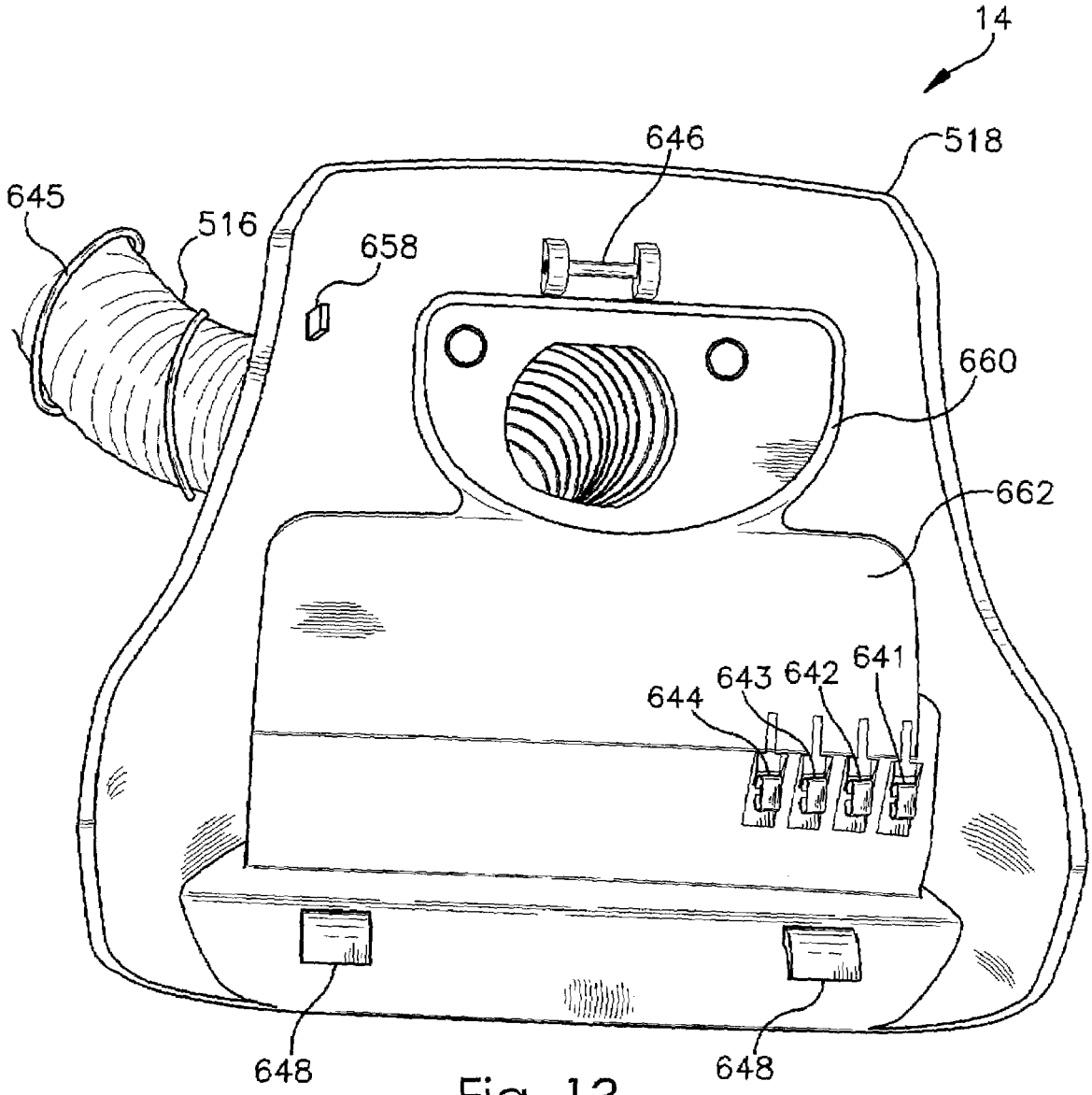
FIG. 13 is a perspective view of a portion of the power head assembly.

As shown in FIGS. 12-13, the connector 518 supports four electrical contacts 641, 642, 643 and 644—ground, 5VDC-in, 24VDC-in and resistance-sense—that engage corresponding electrical contacts 71, 72, 73 and 74 (FIG. 2) of the base 10. A three-conductor electrical line 645 extends from the first three contacts 641-643 to the power head 172. The line 645 conducts 5VDC and 24VDC from the base 20 to power the headlamp 524 and the brushroll motor 534, respectively. The electrical power conducted to the headlamp 524 and the brushroll motor 534 can be manually interrupted with a power switch 646 located on the rigid tube 514 in front of the handgrip 540. The connector 518 has a latch pin 646, two hooks 648 and a prong 658 corresponding to those of the vacuuming head 12. The connector 518 further has upper and lower sealing surfaces 660 and 662 to sealingly engage the upper and lower gaskets 49 (FIG. 2) of the base 20.

Figure 14:
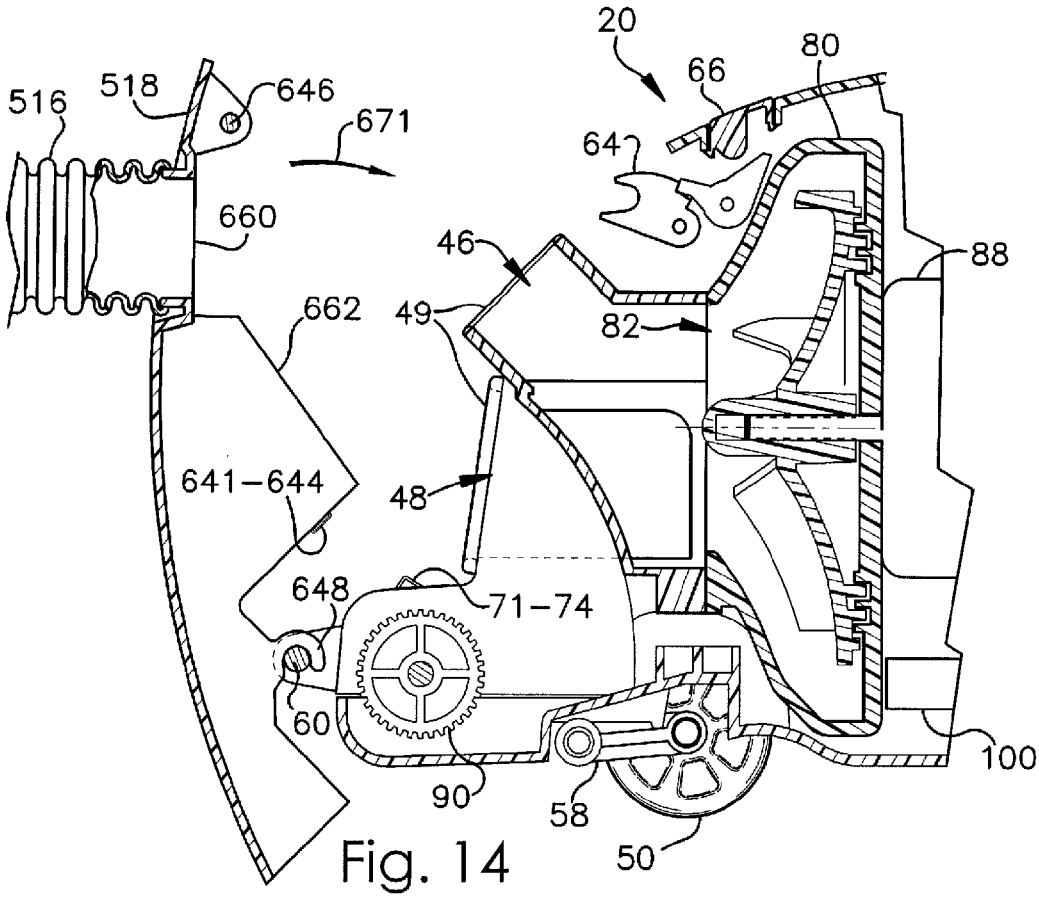
FIG. 14 is a side sectional view illustrating a procedure for attaching the power head assembly to the base.

The connector 518 can be installed on the base 20 in a manner similar to that explained above for the vacuuming head 12. Referring to FIG. 14, first the perch hooks 648 are mounted on the perch pins 60 of the base 20. Then, the connector 518 is pivoted rearward (arrow 671) about the perch pins 60 until the latch pin 646 is captured by the latch 64 of the base 20, thus bringing the connector 518 into an installed position shown in FIG. 15.

In the installation procedure shown in FIG. 14, the pivotal movement (arrow 671) of the connector 518 toward and into its installed position moves the contacts 641-644 of the connector 518 toward and into contact with the contacts 71-74 (FIG. 2) of the base 20, and moves the prong 658 (FIG. 13) toward and into engagement with the sensor switch 76, and moves the sealing surfaces 660 and 662 of the connector 518 into sealing engagement with the gaskets 49 of the base 20. The base's perch pins 60 facilitate the installation procedure by supporting the weight of the connector 518 and by keeping components of the connector 518 properly aligned with mating components of the base 20 while the connector 518 is pivoted.

Figure 15:
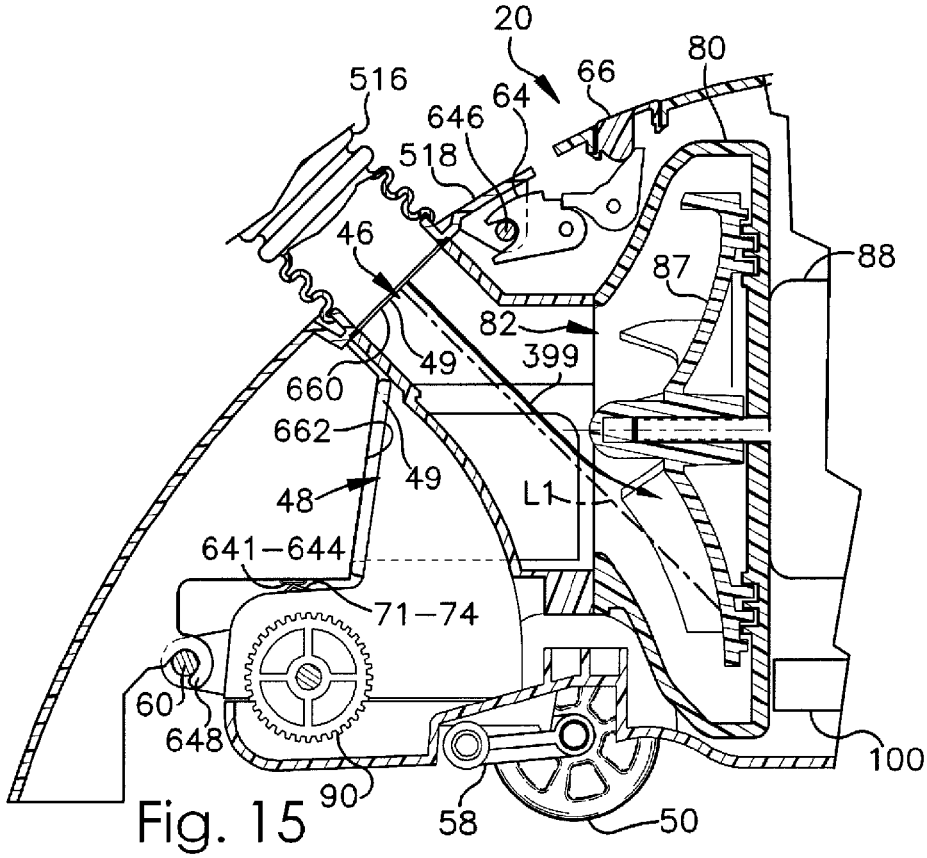
FIG. 15 is a side sectional view of the power head assembly attached to the base.

In its installed position shown in FIG. 15, the flexible tube 516 channels air into the upper inlet port 46 while the connector's sealing surface 662 covers and blocks the lower inlet ports 48. The controller 100 (FIG. 3) determines that the power head assembly 14 is installed by the resistance applied by the assembly 14 across the ground and resistance-sense contacts 71 and 74. In response, the controller 100 disengages the clutch 98, and thus disengages the drive pulley 90 from the motor 88.

Referring to FIG. 12, pressing the main power switch 104 starts the fan motor 88 to drive the fan 80. Pressing the power switch 646 at the handgrip 540 starts the power head motor 534 to drive the brushroll 530. A user grasps the handgrip 540 to move the power head 510 about the floor 6. The headlamp 524 illuminates the floor 6 in front of the power head 510. The brushroll 530 rotates against the floor 6 to dislodge dirt. The dislodged dirt is carried by a flow of air from the floor 6 though the nozzle cavity 521, the tubes 514 and 516, the upper inlet port 46 (FIG. 15), the fan 80 and the fill tube 87 (FIG. 2) into the filter bag 24. This route includes the flow path 399 that extends continuously rearward from the upper inlet port 46 to the impeller 87 and that frilly includes the first imaginary straight line L1 extending from the inlet port to the impeller 87.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A vacuum cleaner comprising:

a base including first and second inlet ports and a fan configured to draw air through the inlet ports into the base;

a vacuuming head removably attachable to the base to channel air from a surface into the first inlet port to clean the surface while covering and blocking the second inlet port; and an attachment, different than the head, removably attachable to the base to channel air into the second inlet port;

wherein the head has a blocking structure configured to cover and block the second inlet port while the head is attached to the base and to be manually moved away from the second inlet port while the head remains removably attached to the base to uncover and unblock the second port.

2. The cleaner of claim 1 wherein, when the blocking structure is moved away from the second inlet port, the attachment can be removably attached to the base while the head remains removably attached to the base.

3. A vacuum cleaner comprising:

a base including first and second inlet ports and a fan configured to draw air through the inlet ports into the base;

a vacuuming head removably attachable to the base to channel air from a surface into the first inlet port to clean the surface while covering and blocking the second inlet port; and an attachment, different than the head, removably attachable to the base to channel air into the second inlet port;

wherein the attachment is configured to cover and block the first inlet port when removably attached to the base.

4. A vacuum cleaner comprising:

a base including first and second inlet ports and a fan configured to draw air through the inlet ports into the base;

a vacuuming head removably attachable to the base to channel air from a surface into the first inlet port to clean the surface while covering and blocking the second inlet port; and an attachment, different than the head, removably attachable to the base to channel air into the second inlet port;

wherein the fan has an inlet through which the fan draws air through the inlet ports, and the attachment is configured to be inserted through second inlet port and to isolate, within the base, the first inlet port from the fan inlet.

5. A vacuum cleaner comprising:

a base including first and second inlet ports and a fan configured to draw air through the inlet ports into the base;

a vacuuming head removably attachable to the base to channel air from a surface into the first inlet port to clean the surface while covering and blocking the second inlet port; and an attachment, different than the head, removably attachable to the base to channel air into the second inlet port;

wherein the attachment is a cleaning attachment for cleaning a household surface.

6. The cleaner of claim 5 wherein both inlet ports are at a front end of the base.

7. An apparatus comprising:

a base including first and second inlet ports and a fan configured to draw air through the inlet ports into an inlet of the fan;

a first attachment configured to be removably attached to the base to channel air into the first inlet port and prevent air from flowing through the second inlet port into the fan inlet; and a second attachment configured to be removably attached to the base to channel air into the second inlet port and prevent air from flowing through the first inlet port into the fan inlet;

wherein the second attachment prevents air from flowing through the first inlet port into the fan by covering and blocking the first inlet port.

8. A vacuum cleaner comprising:

a base having a front end, first and second inlet ports in the front end and an impeller behind the ports, and defining a first flow path extending continuously rearward from the first inlet port to the impeller and a second flow path extending continuously rearward from the second inlet port to the impeller;

a vacuuming head removably attachable to the base to conduct air from a surface into the first inlet port to clean the surface; and an attachment, different than the head, removably attachable to the base to conduct air into the second inlet port;

wherein an imaginary straight line extending from the first inlet port to the impeller is fully included in the first flow path.

9. The cleaner of claim 8 wherein an imaginary straight line extending from the second inlet port to the impeller is fully included in the second flow path.

10. A vacuum cleaner comprising:

a base having two inlet ports and an impeller configured to rotate to draw air through the inlet ports into the base, with a first imaginary straight line extending unobstructedly from the first inlet port to the impeller and a second imaginary straight line extending unobstructedly from the second inlet port to the impeller;

a vacuuming head attachable to the base to conduct air from a surface into the first inlet port to clean the surface; and an attachment, different than the head, removably attachable to the base to conduct air into the second inlet port.

11. The cleaner of claim 10 wherein the head is removably attachable to the base.

* * * * *